US011725344B2

(12) United States Patent
Hagfors et al.

(10) Patent No.: US 11,725,344 B2
(45) **Date of Patent: *Aug. 15, 2023**

(54) FIBER WEB MACHINE SLEEVE ROLL BELT

(71) Applicant: Valmet Technologies Oy, Espoo (FI)

(72) Inventors: Satu Hagfors, Ylöjärvi (FI); Vesa-Matti Riihioja, Tampere (FI)

(73) Assignee: VALMET TECHNOLOGIES OY, Espoo (FI)

( * ) Notice: Subject to any disclaimer, the term of this patent is extended or adjusted under 35 U.S.C. 154(b) by 143 days.

This patent is subject to a terminal disclaimer.

(21) Appl. No.: 17/325,019

(22) Filed: May 19, 2021

(65) Prior Publication Data

US 2021/0363698 A1 Nov. 25, 2021

(30) Foreign Application Priority Data

May 20, 2020 (EP) ..... 20175592

(51) Int. Cl.
*D21F 3/02* (2006.01)
*D21F 1/40* (2006.01)

(52) U.S. Cl.
CPC ..... *D21F 3/0227* (2013.01); *D21F 1/40* (2013.01)

(58) Field of Classification Search
CPC ..... D21F 3/0227; D21F 3/0236; D21F 1/40; D21F 3/10; D21F 3/029; D21F 1/48; D21F 1/483; D21F 1/486
USPC ..... 162/210, 314
See application file for complete search history.

(56) References Cited

U.S. PATENT DOCUMENTS 5,062,924 A 11/1991 McCarten et al.
5,134,010 A 7/1992 Schiel
7,527,708 B2 * 5/2009 Gustavsson ..... D21G 1/006 162/358.3

FOREIGN PATENT DOCUMENTS

EP 3333314 * 6/2018 ..... D21F 9/00
EP 3333315 * 6/2018 ..... D21F 9/00
EP 3382094 * 10/2018 ..... D21F 9/00
WO 2018097777 A1 5/2018

OTHER PUBLICATIONS

Extended European Search Report for EP20175592.3 dated Nov. 3, 2020.

* cited by examiner

*Primary Examiner* — Eric Hug
(74) *Attorney, Agent, or Firm* — Stiennon & Stiennon

(57) ABSTRACT

A belt (10) for a sleeve roll forms a closed loop and has an inner surface (11), an outer surface (12), an elastic body (15), and a reinforcing structure (30). The reinforcing structure has first yarns (31*a*) arranged to a first direction (D1) of the belt, and second yarns (32*a*) arranged to a second direction (D2) of the belt which is parallel or substantially parallel to a travel direction of the belt, and/or perpendicular or substantially perpendicular to the first direction (D1). The belt (10) is configured to stretch elastically more in the second direction (D2) than in the first direction (D1) so that it will return to its original length after forces stretching the belt have been removed. This invention further relates to an arrangement including a belt and a sleeve roll. This invention further relates to a use of a belt.

25 Claims, 4 Drawing Sheets

FIBER WEB MACHINE SLEEVE ROLL BELT

CROSS REFERENCES TO RELATED APPLICATIONS

This application claims priority on application EP20175592, filed May 20, 2020, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to a belt for a sleeve roll and an arrangement comprising a belt and a sleeve roll.

Paper machines, as well as board, pulp and tissue machines, which can generically be referred to as a fiber web machine, are typically equipped with a forming section, a press section and a drying section. In paper, pulp and board making, it is an issue how to increase the dewatering amount from wet fiber web in order to improve a production efficiency.

Nowadays, these machines typically have belts and wires to remove water from the fiber web. Water can be removed e.g. on the forming section through at least one forming wire.

A sleeve roll can be used e.g. in the forming section to improve dewatering from the web. The sleeve roll must have a sleeve roll belt. However, it has been challenging to obtain a belt able to perform well with sleeve rolls.

SUMMARY OF THE INVENTION

The present invention discloses a novel belt for a sleeve roll. A novel arrangement comprises a belt and a sleeve roll.

The object of the present invention is to provide an improved belt for a sleeve roll. Aspects of the invention are characterized by what is stated in the independent claims. Various embodiments of the invention are disclosed in the dependent claims.

The sleeve roll is typically located at a wire section of a paper, board, pulp, or tissue machine, i.e., generically a fiber web machine. Thanks to the sleeve roll, moisture removal of the wire section can be improved.

The novel belt, also referred as a sleeve roll belt herein, is suitable for a sleeve roll of a paper, board, pulp, or tissue machine. The structure of the sleeve roll having a curve element on its outer surface differs from a structure of a shoe press, hence, properties needed for a sleeve roll belt differ from properties needed for a shoe press belt. For example, shoe press belts must be able to handle stresses caused by the long nip of the shoe press. The long nip of the shoe press causes high stresses to the belt due to the sharp deflections upon an entrance into and emergence from the pressing zone. The sleeve roll does not have said long nip; hence, the sleeve roll belt does not need to handle those kind of stresses. However, the sleeve roll belt must have suitable properties to handle stresses caused by the curve element of the sleeve roll. Belts used for shoe presses have not been able to perform properly with sleeve rolls. Thus, there has been a need for an improved belt suitable for a sleeve roll.

The belt for a sleeve roll can form a closed loop and comprise:

an inner surface, an outer surface, an elastic body, and a reinforcing structure, preferably arranged at least partially inside the elastic body.

The reinforcing structure can be a support structure supporting the elastic body.

The reinforcing structure can comprise first yarns forming a first yarn layer. The reinforcing structure can further comprise second yarns forming a second yarn layer. The second yarn layer can be the outermost yarn layer closest to the outer surface of the belt.

First yarns are arranged to a first direction of the belt, and second yarns are arranged to a second direction of the belt. The second direction is preferably perpendicular or substantially perpendicular to the first direction. The second direction can further be parallel or substantially parallel to a travel direction of the belt. Further, the first direction can be parallel or substantially parallel to an axis of rotation of the belt.

The second yarns of the second yarn layer can be arranged, at least partially, on the elastic body of the belt. Therefore, the second yarns can be at least partially visible to a human eye. Thus, in this embodiment, the second yarns are not fully surrounded by the material of the elastic body, but they may be partially surrounded by the material of the elastic body. The technical effect is that the neutral axis of the belt can be near the outer surface of the belt. This can significantly reduce wear of the belt and provide a longer life for the belt. Furthermore, the second yarns can form grooves between adjacent yarns. Thus, water removal rate can be improved.

In addition, or alternatively, the second yarns can be arranged at least partially in the elastic body. Thus, in this advantageous example, the second yarns may be surrounded by the material of the elastic body. Therefore, the second yarns can be embedded in the elastic body. Further, said elastic body material may form grooves on the surface of the belt, which grooves may not harm the second yarns. Thus, it may be possible to improve water removal efficiency of the belt.

Therefore, the second yarns may be arranged to a depth of equal to or less than 3 mm, measured from an outer surface of the elastic body to a bottom of the second yarn in the depth direction of the belt. Thus, the second yarns of the second yarn layer can be arranged on the elastic body of the belt, or partially or fully into the elastic body. Thus, the second yarns may be partially or fully surrounded by the material of the elastic body. Advantageously, the second yarns are arranged to a depth of equal to or less than 2.0 mm, more preferably equal to or less than 1.5 mm, or equal to or less than 0.8 mm, and most preferably equal to or less than 0.5 mm, measured from the outer surface of the elastic body to the bottom of each second yarn in the depth direction of the belt. The technical effect is to provide the neutral axis of the belt near the outer surface of the belt so that wear of the belt can be reduced. This can result a longer life of the belt compared to other belts.

The sleeve roll belt can have a breaking elongation value of equal to or more than 20%, such as in a range between 20 and 25%, measured in the travel direction of the sleeve roll belt. Thus, the sleeve roll belt may not break easily. The breaking elongation value refers to an elongation that is needed to break the belt.

Number of the first yarns can be in a range between 230 yarns/m and 390 yarns/m, preferably from 280 yarns/m to 340 yarns/m. Further, the number of the second yarns can be in a range between 490 yarns/m and 630 yarns/m, preferably from 530 yarns/m to 580 yarns/m. The second yarns arranged in the second direction may have smaller diameter than the first yarns arranged in the first diameter. Thus, the elasticity of the belt may be improved in the second direction. A number of the second yarns per meter can be from 1.25 to 2.8 times a number of the first yarns per meter. Therefore, the belt can have good stretching and strength properties for the sleeve roll.

The second yarns may have a smaller diameter, e.g. at least 5%, preferably at least 10% smaller diameter, than the first yarns. The second yarns of the second yarn layer can be thinner than the first yarns of the first yarn layer in order to obtain good stretchability in the travel direction of the belt. For example, if a diameter of the second yarns is smaller than a diameter of the first yarns, the second yarn layer may be more flexible than the first yarn layer. Further, the elasticity of the belt can be improved in the second direction.

A diameter of the first yarns can be from 0.5 mm to 2.0 mm. The diameter of the first yarns can be equal to or less than 1.8 mm, more preferably equal to or less than 1.5 mm, and most preferably equal to or less than 1.5 mm. Thus, it is possible to obtain a thin sleeve roll belt. Further, the diameter of the first yarns can be equal to or more than 0.6 mm, more preferably equal to or more than 0.8 mm and most preferably equal to or more than 1.0 mm. Thus, the sleeve roll belt can be attached firmly on the sleeve roll.

A diameter of the second yarns may be in a range between 0.5 mm and 1.5 mm. The diameter of the second yarns can be equal to or less than 1.3 mm, more preferably equal to or less than 1.1 mm, and most preferably equal to or less than 0.9 mm. Thus, the sleeve roll belt may have thin yarns, hence, it is possible to obtain a thin sleeve roll belt. Further, stretching properties may be improved in the second direction. Further, the diameter of the second yarns can be equal to or more than 0.5 mm, more preferably equal to or more than 0.6 mm and most preferably equal to or more than 0.7 mm. Thus, it is possible to obtain good strength properties for the belt.

The first yarn layer is preferably the innermost yarn layer, closest to the inner surface of the sleeve roll belt. Thus, the first yarns arranged to the first direction are preferably arranged closest to the inner surface of the sleeve roll belt. These yarns can be embedded in the elastic body. The first yarns are preferably fully surrounded by the material of the elastic body, i.e., the material of the elastic body can surround the yarns on all sides.

Further, the second yarn layer is preferably the outermost yarn layer, closest to the outer surface of the sleeve roll belt. Thus, the second yarns are preferably arranged on the outer surface of the elastic body, and/or close to the outer surface of the belt.

In an embodiment, the second yarns form grooves on the outer surface of the belt. The technical effect is to obtain improved water removal rate. The depth of a groove, formed by the adjacent second yarns, can be more than 0 mm and preferably equal to or less than 2.0 mm, such as in a range between 0.3 mm and 1.5 mm.

In this application, the term "elasticity" refers to an ability of the belt to return to its original shape when a force is removed. Elasticity percentages (%) are values stating how much the belt can stretch elastically. The novel sleeve roll belt can be configured to stretch elastically equal to or more than 1.8% in the travel direction of the sleeve roll belt so that it will return to its original length after the force stretching the belt has been removed. Elasticity of the yarns in the second yarn layer may be e.g., in a range between 1.8% and 2.5%. Further, the sleeve roll belt can be configured to stretch elastically equal to or more than 2.0%, preferably from 2.0% to 5%, in the travel direction of the sleeve roll belt so that it will return to its original length after the force stretching the belt has been removed. Furthermore, elasticity of the yarns of the first yarn layer is preferably smaller, e.g., at least 10% smaller, preferably at least 20% smaller, than elasticity of the yarns in the second yarn layer. The novel sleeve roll belt can be configured to stretch elastically at least 10% more to the second direction than to the first direction. Advantageously, an elasticity of the belt in the first direction is least 20% smaller than an elasticity of the belt in the second direction.

A load at specific elongation (LASE) refers to the load needed for the determined elongation, i.e., load applied for a specified elongation. For example, LASE 2% is a value defined as a measured load when the elongation is 2%. The load at specific elongation is determined based on the standard SFS 2983. The values can be determined by using Alwetron TCT 20 device from Lorentzen & Wettre AB (Lorentzen & Wettre, Sweden).

In addition, a term EASF is used in this technical field, referring to an elongation at specific force. EASF may be used for similar purposes as LASE, but EASF (elongation at specific force) is not the same as LASE (load at specific elongation).

LASE 2% in the travel direction of the sleeve roll belt can be equal to or more than 28 kN/m and preferably equal to or less than 40 kN/m. Further, LASE 4% in the travel direction of the sleeve roll belt can be equal to or more than 49 kN/m and preferably equal to or less than 60 kN/m. This may provide good properties for the sleeve roll belt.

The sleeve roll belt may be configured to stretch with a force of 30 kN/m in the travel direction of the sleeve roll belt so that it will return to its original length after the force stretching the belt has been removed. Thus, the belt may have good stretchability and elasticity in the travel direction of the belt.

The sleeve roll belt can have a breaking strength equal to or more than 100 kN/m, such as from 100 kN/m to 230 kN/m, determined in the travel direction of the sleeve roll belt. The technical effect is that the belt can be installed at a location having heavy stresses. The breaking strength can be determined based on the standard SFS 2983. The values can be determined by using Alwetron TCT 20 device from Lorentzen & Wettre AB (Lorentzen & Wettre, Sweden).

The first yarns may comprise or primarily contain or consist of:

- polyamide (PA), and/or
- polyethylene (PE), and/or
- aromatic polyamide, and/or
- polyester, preferably polyethylene terephthalate (PET), and/or
- carbon fibers, and/or
- carbon/thermoplastic composite.

The second yarns may comprise or primarily contain or consist of:

- polyester, preferably polyethylene terephthalate (PET), and/or
- polyamide (PA), and/or
- polyethylene (PE), and/or
- aromatic polyamide, and/or
- carbon fibers, and/or
- carbon fiber/thermoplastic composite.

Thanks to the novel solution, an improved belt suitable for a sleeve roll can be obtained. The novel sleeve roll belt can have a novel reinforcing structure in the travel direction of the belt. The novel reinforcing structure may be lighter in the travel direction of the belt than a reinforcing structure of conventional belts. Further, the novel sleeve roll belt may have higher elasticity in the travel direction of the belt, compared to elasticity values of conventional sleeve roll belts. Further, the novel sleeve roll belt may have the neutral axis near the outer surface of the belt. Therefore, wear of the belt may be reduced. Furthermore, wear of a wire in contact with the belt may be reduced.

BRIEF DESCRIPTION OF THE DRAWINGS

In the following, the invention will be illustrated by drawings.

The figures are illustrations which may not be in scale. Similar parts are indicated in the figures by the same reference numbers.

DESCRIPTION OF THE PREFERRED EMBODIMENTS

Figure 1A:
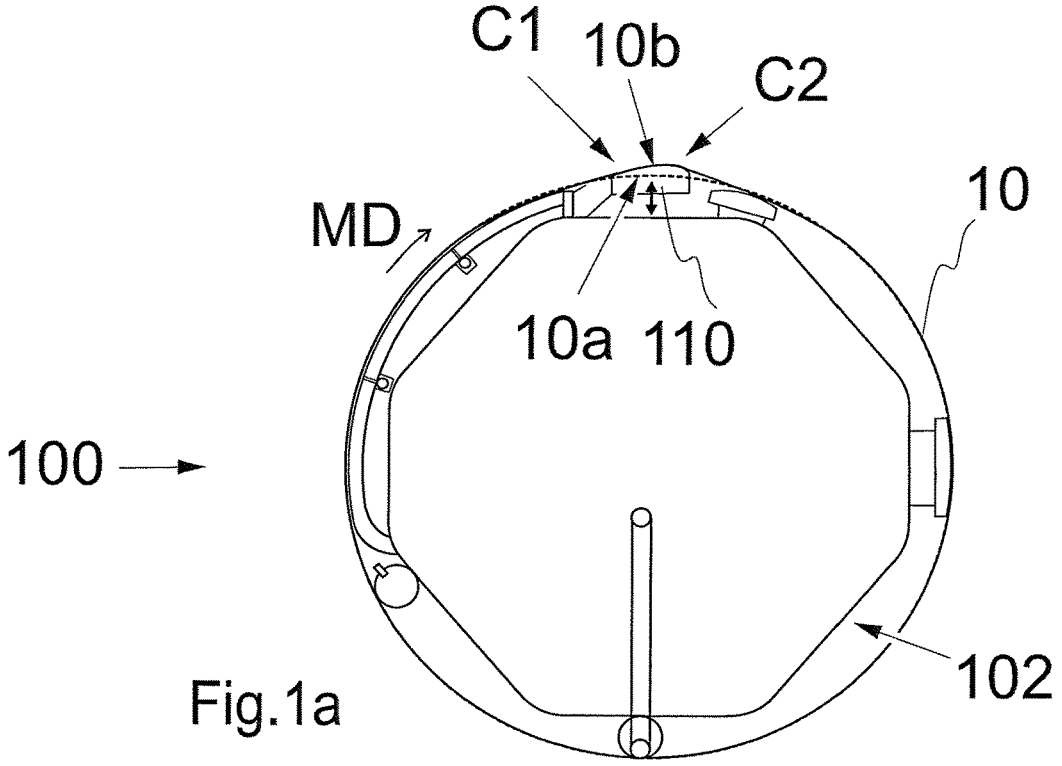
FIGS. 1*a-b* illustrate examples of a sleeve roll.

All embodiments in this application are presented as illustrative examples, and they should not be considered limiting.

The following reference numerals are used in this application:

10 belt,
11 inner surface of the belt,
12 outer surface of the belt,
15 elastic body,
15*a* outer surface of the elastic body,
30 reinforcing structure,
31 first yarn layer of the reinforcing structure,
31*a* first yarn(s), forming the first yarn layer,
32 second yarn layer of the reinforcing structure,
32*a* second yarn(s), forming the second yarn layer,
32*a-i* bottom of the second yarn in the depth direction of the belt, i.e., the innermost surface of the second yarn,
50 grooves on the outer surface of the belt,
53 lands between the grooves,
60 attaching point of the sleeve roll belt,
D1 first direction of the belt,
D2 second direction of the belt,
MD travel direction of the belt,
CD cross direction of the belt,
100 sleeve roll,
102 support shaft of the sleeve roll,
110 curve element of the sleeve roll,
10*a* surface of the movable curve element at a first position,
10*b* surface of the movable curve element at a second position,
T1 depth measured from the outer surface of the elastic body to the bottom level of the second yarn in the depth direction of the belt,
C1 first curve of the sleeve roll, and
C2 second curve of the sleeve roll.

The sleeve roll belt 10 can be an impermeable belt. The sleeve roll belt refers to a belt which is suitable for a sleeve roll.

In this application, the term "yarn" refers to a long structure, which has relatively small cross section. The yarn can be composed of fibers and/or filaments, with or without twist. The yarn can be multiple plied yarn. The yarn can be based on synthetic polymer(s).

The term "filament" refers to a fiber of great length.

The terms "first yarn layer" and "first yarns" refer to yarns which are arranged in a first direction. The first yarn layer may be the innermost yarn layer. The first yarns may be arranged in the cross direction of the sleeve roll belt. In use, the cross direction is parallel to the axis of rotation of the sleeve roll belt.

The terms "second yarn layer" and "second yarns" refer to yarns which are arranged in a second direction. The second yarn layer may be the outermost yarn layer. The second yarns may be arranged in the travel direction of the sleeve roll belt. In use, the travel direction is the direction of rotation of the sleeve roll belt.

Therefore, the term "first yarns" refers to yarns of the first yarn layer and the term "second yarns" refers to yarns of the second yarn layer. The belt can comprise the first yarn layer and the second yarn layer. Thus, the sleeve roll belt can have several yarns arranged in at least two direction.

The first yarn layer can consist of separate yarns. Thus, the adjacent yarns of the first yarn layer can be spaced from each other.

Further, the second yarn layer can consist of separate yarns. Thus, the adjacent yarns of the second yarn layer can be spaced from each other.

In this application, the terms "travel direction" MD and "cross direction" CD are used. The travel direction MD refers to the direction of rotation of the sleeve roll belt in use. The cross-direction CD refers to the longitudinal direction, typically transverse to the travel direction MD of the belt 10. In use, the cross-direction is parallel to the axis of rotation of the sleeve roll belt.

In this application, the term "substantially parallel" means that one direction does not deviate from said substantially parallel direction by more than 10 degrees, more advantageously not by more than 5 degrees, and most preferably not by more than 3 degrees. Thus, e.g. "substantially parallel to the travel direction" means, in this application, that a direction does not deviate from said travel direction by more than 10 degrees, more advantageously not by more than 5 degrees, and preferably not by more than 3 degrees. Furthermore, e.g. "substantially parallel to the cross-direction" means, in this application, that a direction does not deviate from said cross-direction by more than 10 degrees, more advantageously not by more than 5 degrees, and preferably not by more than 3 degrees.

In this application, the term "first direction" D1 refers to a direction to which the first yarns are arranged. The first direction is preferably parallel or substantially parallel to the cross direction of the belt. Further, the term "second direction" D2 refers to a direction to which the second yarns are arranged. The second direction is preferably parallel or substantially parallel to the travel direction of the belt.

However, in an embodiment, the first direction has an angle in a range between 10° and 25° to the cross direction of the belt and/or the second direction has an angle in a range between 10° and 25° to the travel direction of the belt.

Furthermore, the term thickness of the belt will be used, referring to the depth direction of the belt.

Typically, in paper, board, pulp and tissue machines, the fiber web is produced and treated in an assembly formed by several apparatuses arranged consecutively in a process line. A typical production line comprises a forming section comprising a headbox and a wire, a press section, a drying section and, finally, a reel-up. Further, the production line typically comprises e.g. at least one winder for forming customer rolls.

In the forming section, a headbox is used to form the fiber web. Further, some water can be removed through at least one forming wire. The sleeve roll 100 can be located in the forming section for improving water removal therein. The present invention relates to a belt 10 for a sleeve roll 100. The sleeve roll 100 can be located e.g. in a bottom layer wire loop. The sleeve roll may be used e.g. for joining layers of a multi-ply fiber web in a sleeve roll nip between the sleeve roll and the opposite wire of a twin-wire forming part.

In this application, the terms "belt" and "sleeve roll belt" refer to a belt suitable for a sleeve roll unless otherwise stated. The sleeve roll belt 10 can be suitable for a sleeve roll of a paper, board, pulp, or tissue machine. The sleeve roll belt 10 can be arranged on a sleeve roll 100 which can be located e.g. at a wire section of a paper, board, pulp, or tissue machine. The sleeve roll belt 10 is typically shaped like an endless loop. The sleeve roll belt can be used to improve water removal from very wet fiber web in the wire section.

Figure 1B:
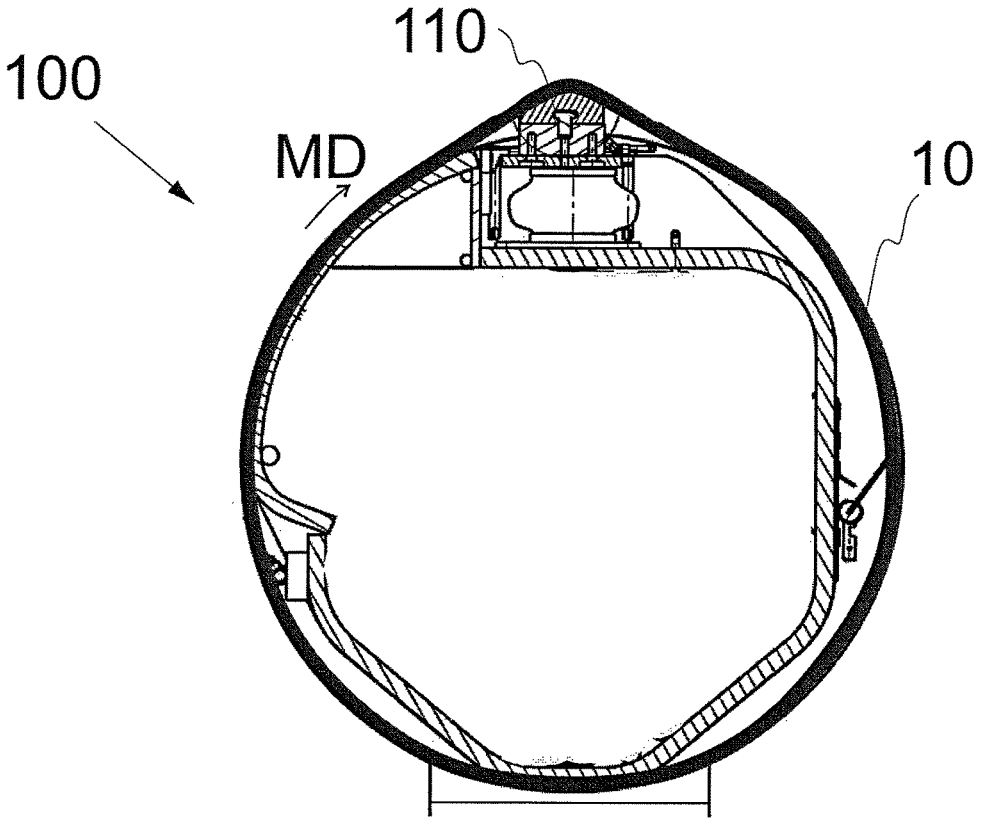
Figure 2A:
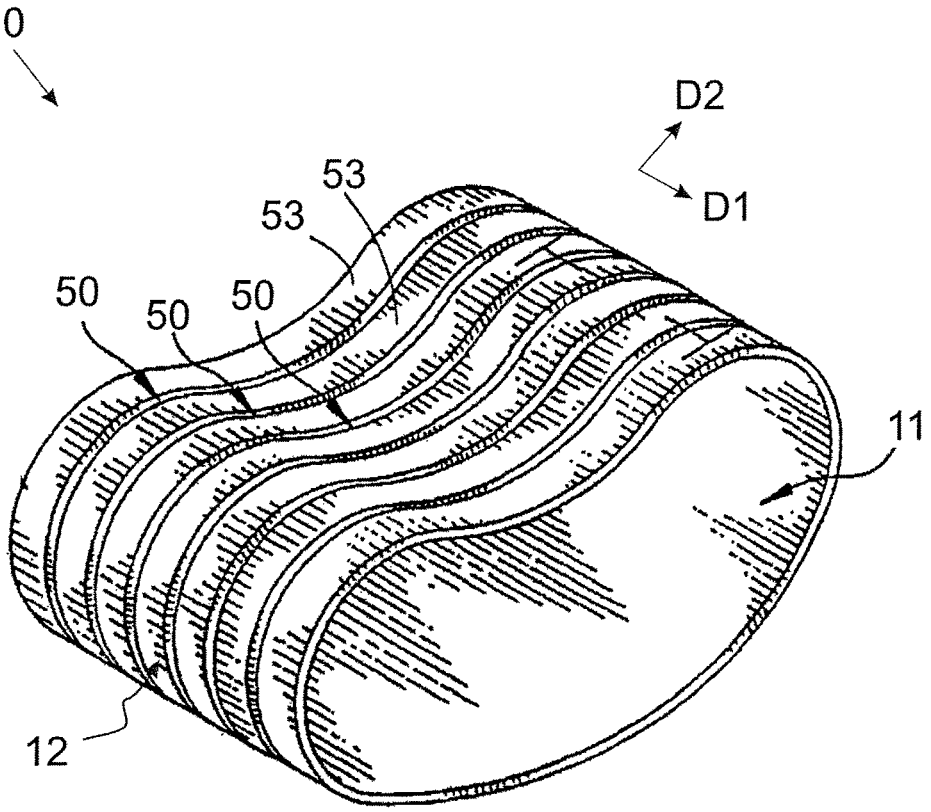
FIGS. 2*a-b* show example structures of a belt.
Figure 2B:
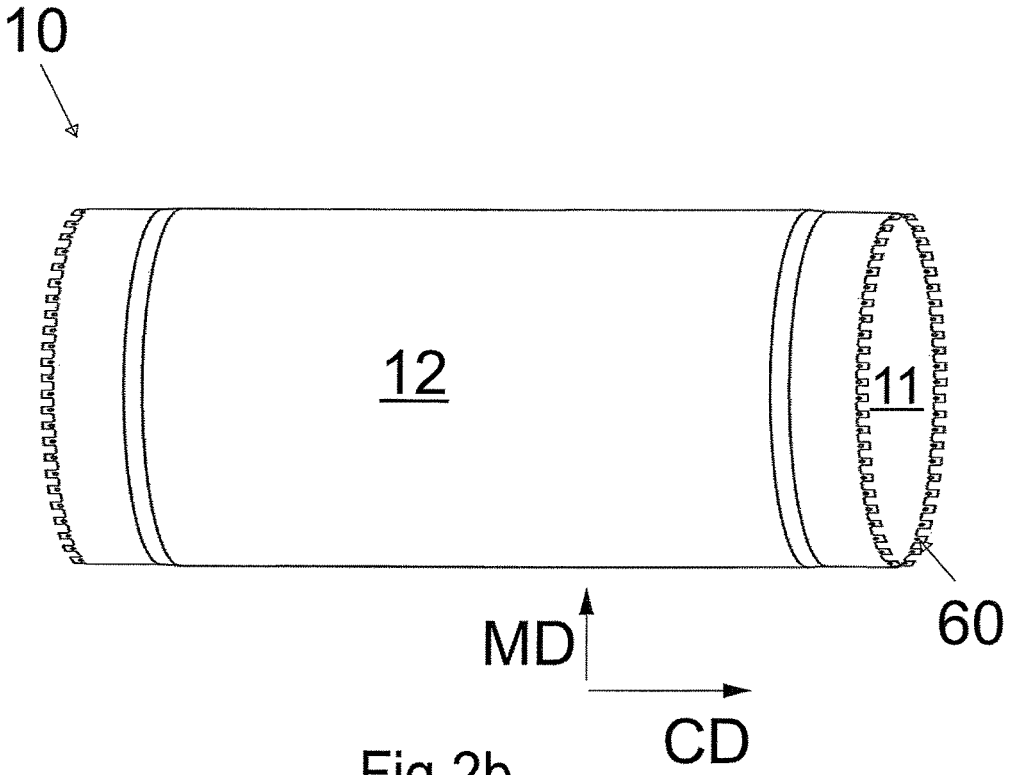

Examples of a sleeve roll 100 is illustrated in FIGS. 1*a-b*. The sleeve roll 100 can comprise a support shaft 102. The sleeve roll further comprises the sleeve roll belt 10 which is typically located around an outer surface the sleeve roll 100. The sleeve roll belt 10 can be led to circle around the support shaft 102.

Still further, the sleeve roll 100 can comprise support elements located at a distance from each other on the support shaft 102. The sleeve roll belt 10, which can circle around the outer surface of the sleeve roll, can be supported by the support elements.

The sleeve roll 100 can further comprise a curve element 110. In operation, the sleeve roll belt typically runs through the dewatering zone on the curve element. The curve element 110 can cause increased forces which stretch the sleeve roll belt on the curve element 110. The curve element 110 can be movable, i.e., a radius of curvature of the sleeve roll belt on the on the surface of the curve element 110 can be controlled by moving the curve element 110 towards the center of the sleeve roll or outward from the outer surface of the sleeve roll. Thus, stretching of the sleeve roll belt 10 may vary from a normal rate to a very high rate.

The sleeve roll belt 10 is or can be arranged in connection with the sleeve roll 100 in such a way that its outer surface 12 faces the fiber web and its inner surface 11 faces the sleeve roll. Thus, the sleeve roll 100 can be encircled by the sleeve roll belt 10 having the shape of a loop.

A circumference of the sleeve roll belt may be increased and decreased during operating hours of the belt due to the movable curve element 110. Therefore, the sleeve roll belt may have high elasticity in order to be able to handle the stretching caused by the curve element 110 of the sleeve roll. Further, the sleeve roll belt may have good strength properties so that it does not break easily.

FIG. 1*a* illustrates an example of a sleeve roll 100, which comprises a stationary support shaft 102 and the sleeve roll belt 10. The sleeve roll belt 10 is led to circle around the stationary support shaft 102. Further, wire(s) can be led via the curvilinear dewatering zone C1, C2, which dewatering zone can be supported by the sleeve roll belt 10.

The sleeve roll 100 can comprise at least one curvilinear dewatering zone C1, C2 comprising typically at least two partial curves C1, C2 such that the radius of curvature of a first partial curve C1 may be greater than the radius of curvature of a second partial curve C2 following the first partial curve in the travel direction MD of the sleeve roll belt. This can improve the water removal from the fiber web.

The curvilinear dewatering zone C1, C2 may be formed by the curve element 110 of the sleeve roll 100. The degree of curvature of the curve element 110 can increase in the travel direction of the belt 10 such that increasing dewatering pressure is applied to the fiber web travelling between the wires on said at least one curvilinear dewatering zone C1, C2 on the curve element 110. The curvilinear dewatering zone C1, C2 on the curve element 110 may contain several curves such that the radius of curvatures preferably decreases in the running direction of the wires. This can improve the water removal from the fiber web.

The sleeve roll 100 can comprise lubricant between the inner surface 11 of the sleeve roll belt 10 and the outer surface of the sleeve roll 100. Thus, the sleeve roll can comprise e.g. a lubricating pump(s), which can be used to pump lubricant into a gap between said belt 10 and the outer surface of the sleeve roll.

The curve element 110 may be moved between two or more than two positions. Therefore, the curve element 110 may be used for controlling the radius of curvature of the belt 10 on the curve element 110.

The first position of the curve element 110 may form a first surface 10*a* on the curve element. The first surface 10*a* may have the same radius of curvature as the surface near the curve element.

In the second position of the curve element 110, an outer surface of the curve element may be moved outward. Thus, the second position of the curve element 110 may form a second surface 10*b* on the curve element. The second surface 10*b* may have decreased radius of curvature, if compared to surfaces near the curve element.

In the second position of the curve element 110, the sleeve roll belt 10 may need to stretch due to the curve element 110. Further, if the curve element 100 is movable, the sleeve roll belt 10 may need to return to its original shape when the curve element is moved back to the first position. Thus, the sleeve roll belt 10 may need to have good elasticity as well as suitable strength properties.

As discussed above, the sleeve roll belt 10 can be arranged to run around the sleeve roll 100. The inner surface 11 of the sleeve roll belt 10 can slide against the outer surface of the sleeve roll 100. A fiber web to be treated can be led to the sleeve roll belt 10, typically supported by one or more than one fabric, such as a wire.

The belt 10 has a length, a circumference, and a thickness. The thickness is the smallest dimension. The circumference and the length can be selected for adapting the belt to a sleeve roll 100. The circumference of the sleeve roll belt 10 is determined to be such that the inner diameter of the sleeve roll belt 10, when in operation, will be suitable for the sleeve roll.

The circumference of the sleeve roll belt 10, that is, the length of one rotation, may be equal to or more than 2.2 m, for example equal to or more than 3.0 m, or equal to or more than 3.4 m. Furthermore, the circumference of the belt 10 is preferably not greater than 6.3 m, for example equal to or less than 6.0 m, or equal to or less than 5.8 m. The length of the belt in the cross direction is determined according to the machine width and may be, for example, in a range between 1.5 m and 12.6 m.

The thickness of the sleeve roll belt can be at least 1.5 mm, more preferably at least 2.0 mm, and most preferably at least 2.5 mm. Thus, it is possible to arrange at least some yarns into the belt. Furthermore, the thickness of the sleeve roll belt can be equal or less than 7 mm, more preferably equal to or less than 5 mm, and most preferably equal to or less than 4 mm, for example in a range of 2.5 mm-5 mm. This thickness can be particularly suitable for sleeve rolls. Further, said thickness together with materials and a reinforcing structure of the belt can provide good strength properties for the sleeve roll belt.

Figure 3A:
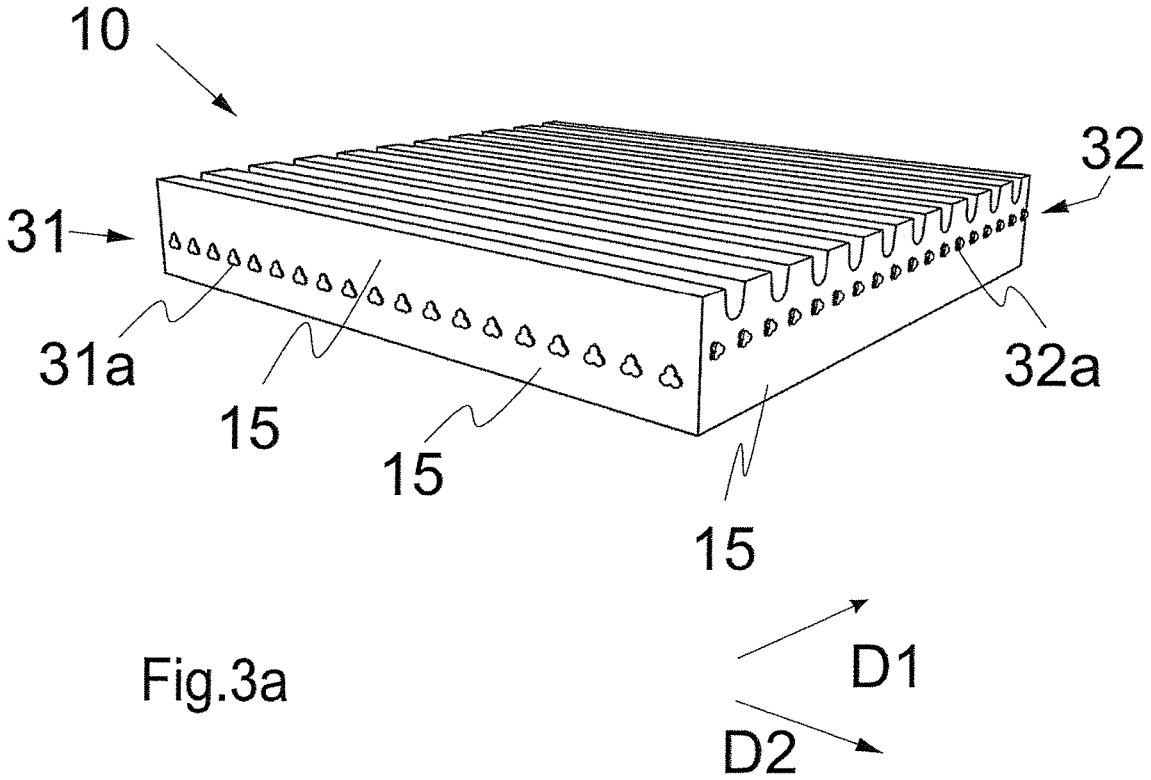
FIGS. 3*a*-4*b* illustrate some examples for internal structure of the belt.
Figure 3B:
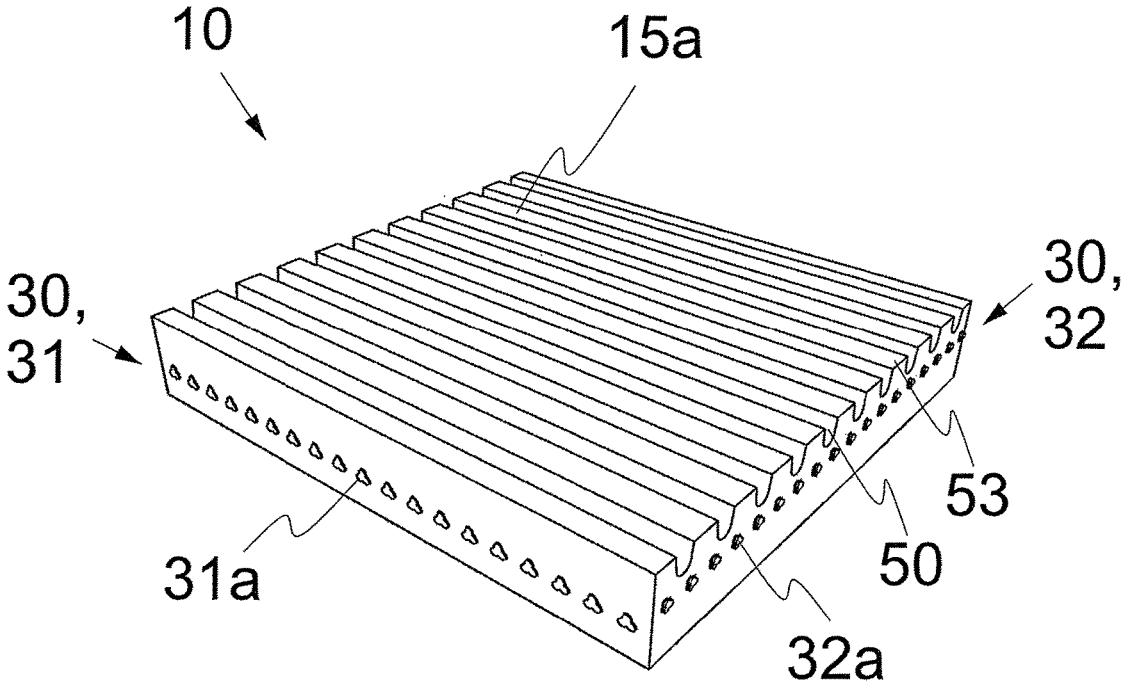

The outer surface 12 of the sleeve roll belt can comprise several parallel grooves 50 as shown e.g. in FIGS. 3*a*-*b* in order to improve dewatering properties of the sleeve roll belt 10.

Figure 4A:
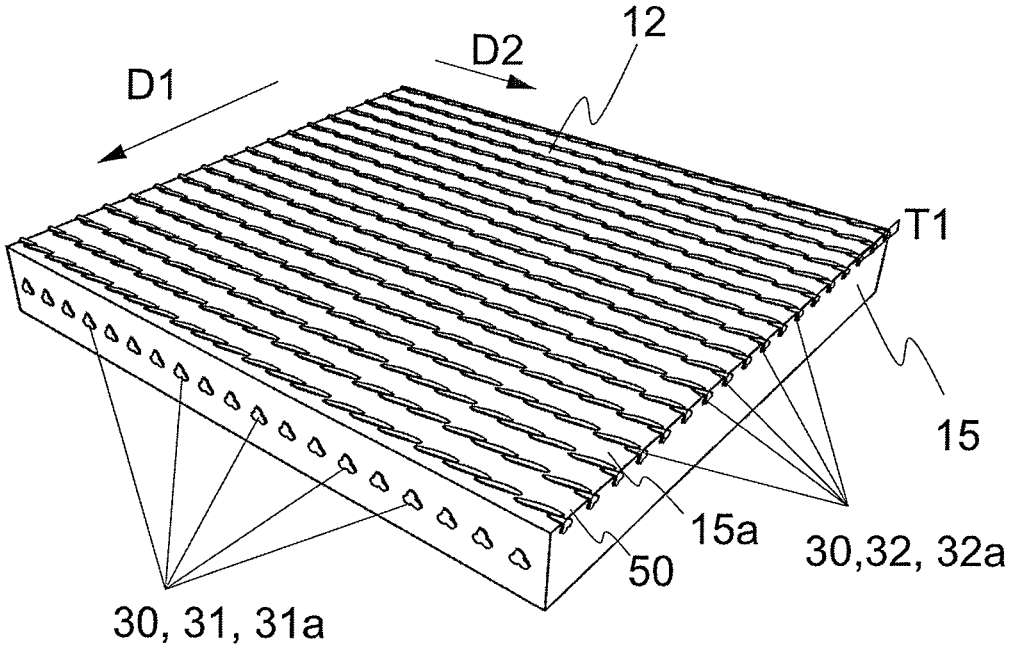
Figure 4B:
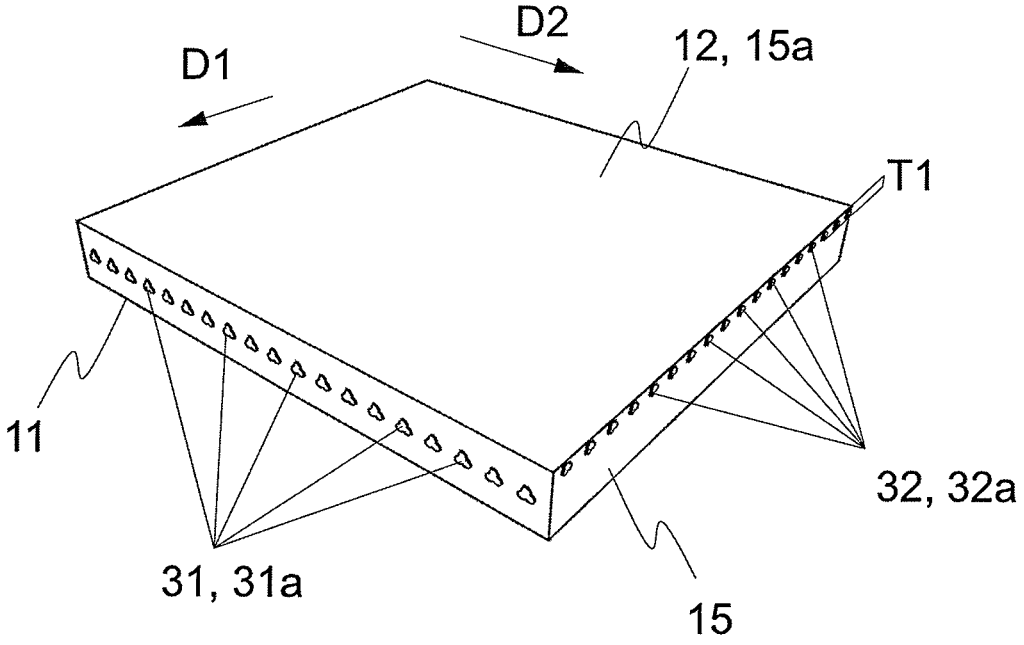

Alternatively, the outer surface 12 of the sleeve roll belt can be substantially smooth as shown e.g. in FIG. 4*b*. Thus, the elastic body 15 may not form said grooves 50. Thus, it is possible to dispose at least some reinforcement yarns near the outer surface 12 of the belt. This can reduce wear of the sleeve roll belt.

If the outer surface of the belt comprises the grooves, they are typically arranged in the travel direction of the sleeve roll belt. The grooves 50 can be separated by lands 53. The function of the dewatering grooves 50 is to enhance the removal of water from the fiber web to be dewatered by means of the sleeve roll belt 10 and thereby to increase the dry content of said fiber web. When the fiber web runs on the curve element 110 and the sleeve roll belt therein, at least some water may run through the wire into the grooves 50.

If the outer surface 12 of the belt has grooves formed by the elastic body material, the depth of said grooves may be e.g. less than 0.3 mm, such as equal to or less than 0.2 mm. Thus, the reinforcement yarns of the second yarn layer may be arranged near the outer surface and/or on the outer surface of the elastic body. Therefore, properties of the sleeve roll belt can be improved so that the surface wear of the belt and a wire therein may be reduced.

The dewatering grooves 50 are preferably "endless" and substantially parallel to the travel direction MD of the sleeve roll belt 10; that is, they extend substantially in the direction of rotation of the sleeve roll belt 10 in use. In other words, in use, the sleeve roll belt 10 is fitted or is intended to be fitted in a target, such as the wire section of a paper machine, in such a way that said dewatering grooves 50 will, when facing the fiber web, preferably extend in the running direction of the fiber web, i.e. in the so-called machine direction, or at least substantially in said machine direction.

The dewatering grooves 50 may be separate grooves extending around the sleeve roll belt 10, or they may be continuous spiral grooves. The angle of the dewatering grooves with respect to the machine direction, i.e. the direction of rotation of the sleeve roll belt, is advantageously not greater than 2°, such as, for example 0° to 2°, more advantageously not greater than 1°, and preferably not greater than 0.5°, such as 0.0° to 0.5°. In this way, dewatering can be particularly effective, especially when using together with a sleeve roll comprising the curve element 110.

The depth of the dewatering groove 50 is advantageously at least 0.4 mm and not greater than 2.0 mm, measured from the deepest point of the dewatering groove. The width of the dewatering groove 50 can be equal to or more than 0.5 mm and not greater than 2.0 mm. The distance between the central lines of two parallel adjacent dewatering grooves 50 is advantageously at least 1.5 mm and not greater than 7.0 mm. The width of the land 53, 32*a* between two dewatering grooves 50 is advantageously at least 1.0 mm and not greater than 5.0 mm. The total water volume of the dewatering grooves 50 can be e.g. between 100 and 800 g/m2. Factors effective on the water volume of the outer surface of the sleeve roll belt include the cross-sectional area of the dewatering grooves as well as the density of the dewatering grooves (number/m in the cross direction). Preferably, the number of dewatering grooves 50 is at least 140/m, more advantageously at least 200/m and advantageously not greater than 670/m. With the above-mentioned features of the dewatering groove 50 (depth, width, distance between central lines, width of ridge, water volume, number of dewatering grooves), water can be removed from the web more efficiently via said dewatering groove 50. These benefits are typically realized the better, the more of above-mentioned features are implemented in the sleeve roll belt 10.

The outer surface 12 of the sleeve roll belt can comprise several parallel grooves 50 formed between two adjacent second yarns 32*a*. This may improve dewatering properties of the sleeve roll belt. The grooves 50 formed between the second yarns 32*a* are illustrated in FIG. 4*a*. Thus, the second yarns 32*a* can be arranged on the surface of the elastic body so that the grooves are formed between said adjacent second yarns. The grooves 50 can be separated by the second yarns 32*a*. The depth of the groove 50 formed between the adjacent second yarns 32*a* is preferably from 0.1 mm up to a diameter of the second yarns forming the groove. The depth of the groove formed between two adjacent second yarns 32*a* can be e.g. at least 0.4 mm and not greater than 2.0 mm, measured from the deepest point of the dewatering groove to an outer surface of the second yarn 32*a*. The depth of the groove 50 formed between two adjacent second yarns 32*a* is preferably equal to or more than 0.1 mm, more preferably equal to or more than 0.2 mm and most preferably equal to or more than 0.3 mm, measured from the deepest point of the dewatering groove to an outer surface (i.e. top surface) of the second yarn 32*a*. Thus, it is possible to improve water removal rate of the belt. Further, by arranging the second yarns 32*a* near the surface of the belt, it is possible to decrease wear of the belt. Further, the depth of the groove formed between two adjacent second yarns 32*a* is preferably less than 1.5 mm, such as equal to or less than 1.0 mm, more preferably equal to or less than 0.7 mm, and most preferably equal to or less than 0.5 mm, measured from the deepest point of the dewatering groove to an outer surface (i.e., top surface) of the second yarn 32*a*. Thus, the smoothness of the outer surface 12 may be improved. Further, it is possible to use yarns which have a quite small diameter.

The belt 10 can be bendable, i.e., the belt can be capable of being bent at least to a predetermined radius of curvature without breaking. The predetermined radius of curvature can be smaller than radius of curvature of the surface of the curve element 110, in any position of the curve element 110, hence, the belt may not be easily damaged.

The sleeve roll belt 10 can comprise an elastic body 15 in order to have a good elasticity. In this application, the term "elasticity" refers to an ability of the belt to return to its original shape after stretching or pressing. The sleeve roll belt 10 can further comprise a reinforcing structure 30 in order to obtain good strength properties. However, the elasticity of the sleeve roll belt may need to be substantially high, hence, the reinforcing structure should not decrease the elasticity of the sleeve roll belt too much.

The inner surface 11 of the sleeve roll belt can be substantially smooth. The sleeve roll belt 10 may or may not comprise a pattern on the inner surface 11 of the belt 10. The inner surface 11 may comprise a slight patterning, i.e. so-called buffing. The depth of the buffing may be, for example, 0 to 15 μm, preferably from 0.01 μm to 4.00 μm. Furthermore, the depth of the buffing may be advantageously at least 0.05 μm. Said roughness of the inner surface of the belt may have a substantial effect on the durability of the sleeve roll belt. For example, the combination of the outer surface of the sleeve roll 100 and the rough inner surface 11 of the belt 10 would not be as sensitive to decelerate as the combination of the smooth metal surface of the sleeve roll 100 and the smooth inner surface 11 of the sleeve roll belt, particularly in a case of broken uniformity of the lubricating oil film. In such a situation, the sleeve roll belt having an inner surface 11 with a buffing may not be as easily damaged as a belt having a smooth inner surface.

The outer surface 12 of the belt 10 is preferably designed such that it will not cause marking in the fibrous web. The outer surface 12 of the sleeve roll belt can comprise a slight patterning, i.e. so-called buffing. The depth of the buffing on the outer surface 12 of the sleeve roll belt 10 may be, for example, 0 to 50 μm. A suitable roughness of the outer surface of the sleeve roll belt may have advantageous effects on its action together with the paper machine fabric.

The sleeve roll belt 10 can be made of materials, which are suitable for paper, board, pulp, and tissue machines, which do not harm the wire or the fiber web, and which have suitable stretching and strength properties.

The sleeve roll belt can comprise polymer(s). The elastic body 15 may comprise or consist of elastomer material. The elastomer material is preferably the main raw material of the sleeve roll belt.

The sleeve roll belt may comprise or consist of
polyurethane, and/or
natural rubber (NR), and/or
synthetic rubber (SR), the amount of said materials being preferably at least 50 wt. %, more preferably at least 70 wt. %, and most preferably equal to or more than 80 wt. %, calculated from the total weight of the belt. Thus, the elasticity, and bendability of the belt may be improved. These materials can be used to obtain good strength and elasticity properties; hence, the belt may be able to stretch and bend during operating hours without breaking. Furthermore, the sleeve roll belt may comprise not more than 99.9 wt.-%, more advantageously not more than 97 wt.-% and preferably not more than 95 wt.-% said materials, calculated from the total weight of the sleeve roll belt. For example, the reinforcing structure typically comprises other material(s).

The sleeve roll belt may comprise polyurethane. Preferably, the elastic body consists of polyurethane or contains primarily polyurethane. Advantageously, the sleeve roll belt comprises at least 50 wt.-%, more advantageously at least 70 wt.-%, and preferably at least 80 wt.-% polyurethane, calculated from the total weight of the sleeve roll belt. Furthermore, the sleeve roll belt may comprise not more than 99.9 wt.-%, more advantageously not more than 97 wt.-% and preferably not more than 95 wt.-% polyurethane, calculated from the total weight of the sleeve roll belt. Polyurethane may improve the properties of the sleeve roll belt, such as elasticity and bendability, and be particularly suitable for use in combination with the curve element of the sleeve roll.

The curve element 110 of the sleeve roll may cause high stress to the sleeve roll belt. Thus, the sleeve roll belt 10 may need to have suitable reinforcing structure. However, due to the curve element, which typically forces the sleeve roll belt to stretch and/or compress, the sleeve roll belt might need to have both; good strength as well as good elasticity. Conventionally, it has been challenging to obtain a belt for sleeve rolls, which belt had a reinforcing structure providing good strength properties for the belt and did not prevent e.g. a stretching of the belt on the curve element 110.

The reinforcing structure 30 of the sleeve roll belt may comprise:

yarns which are arranged into the belt so that the material of the elastic body surrounds the yards, and/or
yarns which are arranged on the elastic body so that said yarns are at least partially visible to a human eye.

Thus, the belt may comprise yarns which are arranged to the outer surface of the belt and/or near the outer surface of the belt. The novel sleeve roll belt may have good strength properties as well as good elasticity and ability to stretch.

FIGS. 3*a-b* and 4*a-b* illustrate example structures of the belt 10 comprising an elastic body 15 and yarns 32*a*, 31*a*. The elastic body 15 may have an ability to return to its original shape after pressing and stretching. Thus, the elastic body 15 can have a capacity to reassume its initial shape after being e.g. compressed. Said FIGS. 3*a-b* and 4*a-b* illustrate the first yarns 31*a* and the second yarns 32*a*. The belt may comprise the material of the elastic body 15 between the adjacent first yarns 31*a*. Further, the belt may comprise the material of the elastic body 15 between the adjacent second yarns 32*a*.

As discussed above, the sleeve roll belt 10 can comprise a reinforcing structure 30, which is a support structure formed by the yarns 31*a*, 32*a*. The yarns 31*a*, 32*a* are preferably arranged in layers within the elastic body 15. The reinforcing structure 30 may provide suitable strength properties for the sleeve roll belt as well as an ability to return its original shape after the stretching caused by the curve element 110.

The reinforcing structure 30 can comprise a first yarn layer 31 and a second yarn layer 32. The first yarn layer 31 comprises first yarns 31*a* which are arranged in the first direction D1, preferably within the elastic body 15. The second yarn layer 32 comprises second yarns 32*a* which are arranged in the second direction D2.

The first yarns 31 can be arranged perpendicular or substantially perpendicular to the second yarns 32. The technical effect is to provide good strength properties to the travel and cross directions of the sleeve roll belt. Preferably, a total of two reinforcing yarn layers 31, 32 are provided.

As discussed, the reinforcing structure 30 of the sleeve roll belt 10 can comprise the first yarns 31*a* arranged to the first direction D1. An angle between the first yarns 31*a* and the cross-direction CD is preferably less than 15°, more preferably less than 10°, and most preferably less than 5°. The first direction can be parallel or substantially parallel to the cross-direction CD of the sleeve roll belt. The first yarns 31*a* may not need to have high stretchability because the belt does not substantially stretch to the cross direction. Thus, the elasticity of the first yarns 31*a* can be smaller than elasticity of the second yarns 32*a*. However, the first yarns 31*a* may need to have good strength. The technical effect of the first yarns 31*a* may be to improve the dimensional stability of the sleeve roll belt in the cross direction.

Further, as discussed, the reinforcing structure 30 can comprise the second yarn layer 32. The second yarns of the second yarn layer 32 are arranged parallel to the second direction D2 and they may be arranged substantially perpendicular to the first direction D1. An angle between the second yarns 32*a* and the travel direction MD of the belt is preferably less than 15°, more preferably less than 10°, and most preferably less than 5°. The second direction can be parallel or substantially parallel to the travel direction MD of the sleeve roll belt. Thus, it can be possible to form good reinforcing structure for the travel direction of the sleeve roll belt 10. The yarns 32 of the second yarn layer 32 may have high stretchability so that they may perform well with the curve element 110 of the sleeve roll. Further, the second yarns may have good strength properties.

The second yarns 32*a* may provide good stretchability and/or elasticity for the support structure of the belt as well as sufficient strength for the belt in the travel direction of the belt.

The second yarns 32 can be visible to a human eye as shown in FIG. 4*a*. Preferably, the second yarns 32*a* are at least partially embedded in the elastic body as illustrated in FIGS. 3*a-b* and 4*a-b*.

Preferably, the yarns 32*a* of the second yarn layer are arranged at least partially into the elastic body. Therefore, the second yarns 32*a* of the second yarn layer 32 are preferably arranged at least partially into the elastic body of the belt.

The second yarns 32*a* can be arranged at least partially into the elastic body 15 of the belt 10. The second yarns 32*a* can be arranged to a depth T1, which depth T1 is in a range between 0 mm and 3.0 mm measured from an outer surface 15*a* of the elastic body 15 (i.e. from the outer surface of the belt) to a bottom 32*a-i* of the second yarn 32*a* in the depth direction of the belt. Preferably, the second yarns 32*a* are arranged to a depth T1 of equal to or more than 0.2 mm, more preferably to a depth T1 of equal to or more than 0.5 mm, and most preferably to a depth of equal to or more than 1.0 mm, measured from the outer surface 15*a* of the elastic body 15 (i.e. from the outer surface of the belt) to the bottom 32*a-i* of the second yarn 32*a* in the depth direction of the belt. Further, the second yarns 32*a* may be arranged to a depth T1 of equal to or less than 2.0 mm, more preferably to a depth T1 of equal to or less than 1.5 mm, and most preferably to a depth T1 of equal to or less than 1.0 min, such as to a depth T1 in a range between 0.5 mm and 2 mm, measured from the outer surface 15*a* of the elastic body 15 (from the outer surface of the belt) to the bottom 32*a-i* of the second yarn 32*a* in the depth direction of the belt. The technical effect is that the neutral axis of the belt can be near the outer surface of the sleeve roll belt. Thus, in use, a speed difference between the outer surface of the belt, and a surface of a wire which is in contact with the belt may be reduced. Further, thanks to the novel solution, a friction between the belt and the wire may be reduced. Thus, the surface wear of the belt as well as the surface wear of the wire may be reduced. Furthermore, the second yarns may form grooves on the outer surface of the belt. Thus, water removal efficiency of the belt may be improved. If the second yarns 32*a* of the second yarn layer 32 are aligned (at least substantially) in the travel direction of the belt and arranged near the outer surface of the belt, it is possible to significantly decrease wearing of the belt as well as wearing of the wire. Thus, the costs caused by the belt may be decreased.

By arranging the neutral axis of the belt near the outer surface of the belt, the outer surface of the belt can wear less, and the inner surface of the belt may wear more. However, this may not cause problems to the belt, because there is typically a lubricant layer, such as an oil layer, between the outer surface of the sleeve roll and the inner surface of the belt. Thus, the friction between the belt and the sleeve roll is typically very low. Therefore, the inner surface of the belt may not wear much even if the neutral axis of the belt is near the outer surface of the belt.

As discussed above, the reinforcement structure 30 may comprise or consist of two layers 31, 32 of reinforcement yarns. Advantageously, the reinforcement structure consists of said two layers of yarns. The yarns 31*a*, 32*a*, are preferably multifilament yarns with twist. Advantageously, the yarn layers 31,32 are arranged substantially perpendicular to each other. An angle between the first yarns 31*a* of the first yarn layer and the second yarns 32*a* of the second yarn layer is preferably around 90° such as between 80° and 100°.

The first yarns 31*a* can be arranged adjacent to each other at a distance from each other in such a manner that the elastic body material is settled around the yarns 31*a*.

The second yarns 32*a* can be arranged adjacent to each other at a distance from each other in such a manner that the elastic body material is settled around the yarns. Thus, the yarns of the second yarn layer can be arranged inside the elastic body. Alternatively, the second yarns 32*a* can be arranged adjacent to each other at a distance from each other in such a manner that the elastic body material may be settled on some (but not all) surfaces of the second yarns 32*a*. Thus, the second yarns can be arranged to the outer surface 15*a* of the elastic body. Therefore, the second yarn layer 32 may comprise yarns that are arranged on the outer surface 15*a* of the elastic body and/or near the outer surface of the belt.

The diameter of the yarns as well as material and number of the yarns can influence the properties of the sleeve roll belt.

The belt can comprise from 230 to 390 first yarns 31*a*/m arranged in the first direction, which first direction is preferably parallel or substantially parallel to the cross direction of the belt. The number of the first yarns 31*a*/m is preferably equal to or more than 260 first yarns per meter, more preferably at least 270 first yarns per meter, and most preferably equal to or more than 280 first yarns 31*a* per meter. Further, the number of the first yarns is preferably equal to or less than 360 first yarns per meter, more preferably less than 350 first yarns per meter, and most preferably equal to or less than 340 first yarns 31*a* per meter. Thus, it is possible to obtain sleeve roll belt having good strength properties as well as good dimensional stability in the cross direction of the belt. Thus, the belt may be firmly fastened to the sleeve roll.

The belt can comprise from 490 to 630 second yarns 32*a* per meter arranged in the second direction, which second direction is preferably parallel or substantially parallel to the travel direction MD of the belt. The number of the second yarns 32*a* is preferably equal to or more than 490 second yarns per meter, more preferably at least 510 second yarns per meter, and most preferably equal to or more than 530 second yarns 32*a* per meter. Further, the number of the second yarns 32*a* is preferably equal to or less than 620 second yarns per meter, more preferably less than 600 second yarns per meter, and most preferably equal to or less than 580 second yarns 32*a* per meter. Thus, it is possible to obtain good elasticity as well as suitable dimensional stability in the travel direction of the belt.

A relative number of the yarns RNY in the belt can be calculated as follows:

$$RNY=N(32a)/N(31a)$$

wherein N(32*a*) refers to number N of the second yarns 32*a* per meter, and N(31*a*) refers to number N of the first yarns 31*a* per meter.

The relative number of the yarns RNY, i.e., number of the second yarns per meter divided by the number of first yarns per meter can be equal to or more than 1.25, such as in a range between 1.4 and 2.8, preferably in a range between 1.5 and 2.3, and most preferably in a range between 1.6 and 2.0.

The yarns 31*a*, 32*a* in different layers 31, 32 may be either in contact with or bonded to the yarns of the next layer, or they may be spaced from each other. Preferably, the reinforcing yarn layers 31, 32 on top of each other are separated from each other. Thus, the yarn layers do not have to be fastened to each other or bound to each other in any way.

Advantageously, the reinforcing structure 30 comprises yarns arranged in two layers inside the elastic body 15, which layers 31,32 are arranged substantially perpendicular to each other. The second yarn layer 32 can be arranged above the first yarn layer 31 e.g. at a small distance from the first yarn layer. The second yarns can be arranged from 0 mm to 2.0 mm, preferably from 0.2 mm to 1.0 mm above the first yarns.

The first yarn layer 31 can be the innermost yarn layer closest to the inner surface 11 of the sleeve roll belt 10. The first yarn layer 31 can consist of separate yarns. Thus, the adjacent yarns can be spaced from each other. Preferably, the first yarns are spaced evenly or substantially evenly. Each yarn of the first yarn layer can be arranged to be spaced apart by equal distances from adjacent yarns. The adjacent reinforcing yarns of the first reinforcing yarn layer may be spaced apart by e.g. from 1 to 3 mm. The area between the adjacent first yarns preferably consists of the elastic body material.

The second yarn layer can consist of separate yarns, wherein adjacent yarns are spaced from each other. Each second yarn 32*a* of the second yarn layer 32 can be arranged to be spaced apart by equal distances from adjacent yarns. The adjacent reinforcing yarns of the second reinforcing yarn layer may be spaced apart by e.g. from 1 to 3 mm. The area between the reinforcing yarns preferably consists of the elastic body material, if it is not forming a groove 50. The second yarn layer 32 can be the outermost yarn layer closest to the outer surface 12 of the sleeve roll belt.

Therefore, the reinforcing yarns may be separate yarns adjacent to each other, or they may be, e.g., formed of one or more yarns placed spirally in parallel. The adjacent reinforcing yarns of a single reinforcing yarn layer may be spaced apart by, for example, 1 to 3 mm so that the area between the reinforcing yarns preferably comprises or consists of the elastic body material.

The reinforcing yarns may be equal or different in thickness. Preferably, the first yarns are substantially equal in thickness with each other. Further, the second yarns are preferably substantially equal in thickness with each other.

The second yarns of the second yarn layer 32 may be of the same thickness as the first yarns of the first yarn layer 31. However, the second yarns 32*a* are preferably thinner than the first yarns 31*a*. The second yarns 32*a* are preferably equal to or more than 4% thinner than the first yarns 31*a*, for example from 4% to 10% thinner than the first yarns 31*a*. In this way, it may be possible to obtain good strength properties with improved elasticity on the travel direction of the sleeve roll belt as well as good dimensional stability on the cross direction of the sleeve roll belt.

A diameter of each first yarn 31*a* can be e.g. in a range between 0.5 mm and 2.0 mm. The technical effect is to obtain good strength properties as well as good dimensional stability in the cross direction of the belt.

A diameter of each second yarn 32*a* can be e.g. in a range between 0.5 mm and 1.5 mm, preferably in a range between 0.6 mm and 1.2 mm. The technical effect is to obtain good strength properties as well as good elasticity in the travel direction of the belt.

The reinforcing yarns 31*a*, 32*a* of the reinforcing structure 30 of the belt may be made of the same material or different materials. The first yarn layer 31 and the second yarn layer 32 may comprise monofilament yarns and/or multifilament yarns. Thus, each yarn can be monofilament or multifilament. Monofilament means that there is only one filament per yarn. Multifilament means that there is more than one filament per yarn. Multifilament structure can have filaments twisted together. Advantageously, the yarn layers 31,32 comprise or consist of multifilament yarns. The number of filaments has an effect of the properties of the yarns. Preferably, the yarns are multifilament yarns having from 5 to 10000 filaments per yarn.

The first yarns can have equal to or more than 5 filaments per yarn, more preferably equal to or more than 200 filaments per yarn, and most preferably equal to or more than 600 filaments per yarn. Further, the first yarns can have equal to or less than 10000 filaments per yarn, more preferably equal to or less than 4000 filaments per yarn, and most preferably equal to or less than 2000 filaments per yarn.

The yarns of the second yarn layer can have equal to or more than 5 filaments per yarn, more preferably equal to or more than 200 filaments per yarn, and most preferably equal to or more than 400 filaments per yarn. Further, the second yarns can have equal to or less than 10000 filaments per yarn, more preferably equal to or less than 3000 filaments per yarn, and most preferably equal to or less than 1000 filaments per yarn.

The sleeve roll belt 10 may be subjected to high stresses when it is stretched and bended with small radius on the curve element 110 of the sleeve roll. Thus, the yarns 32*a* of the second yarn layer 32 may be made from elastic material (s). The elastic material(s) may allow the sleeve roll belt to bend at a certain radius of curvature, in a manner helping its passage on the surface 10*a*, 10*b* of the curve element.

The yarns may comprise synthetic fibers having high strength, high modulus and high elastic modulus. The yarns can comprise:

- polyamide (PA), e.g. nylon, and/or
- polypropylene (PP), and/or
- polyethylene (PE), preferably so-called high strength polyethylene, and/or
- rayon, and/or
- viscose, and/or
- polyester, preferably polyethylene terephthalate (PET), and/or
- polyvinyl alcohol (PVA, PVOH), and/or
- polyaramide, and/or
- polyphenylene sulfide (PPS), and/or
- liquid crystal plastic (LCP), and/or
- polyimide, and/or
- carbon fibers, preferably carbon fiber/thermoplastic composite, and/or
- polyethylene naphthalate (PEN), and/or
- polyether ether ketone (PEEK).

The amount of said materials is preferably at least 60 wt. %, more preferably at least 80 wt. %, and most preferably at least 95 wt. %, calculated from the total weight of the yarns. Thus, the yarns comprising or consisting of the above-mentioned materials can stiffen the belt, but still allow the necessary level of bending and stretching of the belt.

Preferably, the first yarns 31*a* have substantially low stretchability and high strength. Thus, the belt can be fastened firmly on the sleeve roll. The first yarns preferably comprise or consist of:

- polyamide (PA), and/or
- polyester, preferably polyethylene terephthalate (PET), and/or
- carbon fibers, and/or
- carbon fiber/thermoplastic composite yarns.

For example, carbon fibers can be used to improve strength of the belt. Further, carbon fibers and carbon fiber/thermoplastic composite materials can be used to minimize stretching of the belt in the cross direction. Polyester and polyamide may provide suitable support for the cross direction of the belt. The yarns of the first yarn layer are preferably multifilament yarns, which are either stranded or twisted at a high twist level in a manner known per se.

The yarns of the second layer can have a greater stretchability, e.g. at least 4% greater, more preferably at least 8% greater, than the yarns of the first layer. Thus, the belt can be configured to stretch easily on the curve element of the sleeve roll. The second yarns preferably comprise or consist of:

- polyester, preferably polyethylene terephthalate (PET), and/or
- aromatic polyamide, and/or
- carbon fiber/thermoplastic composite material.

For example, polyester may provide suitable support for the travel direction of the belt. If the yarns of the second yarn layer comprise carbon fiber composites, the belt may not, in some cases, stretch as much as with some other materials. However, carbon fiber composites can improve strength of the belt. The yarns of the second yarn layer are preferably multifilament yarns, which are either stranded or twisted at a high twist level in a manner known per se.

The structure of the second yarn layer 32 can be adapted so that the second yarn layer is more elastically flexible than the first yarn layer. The second yarns can be thinner than the first yarns. This may improve stretchability in the travel direction of the sleeve roll belt 10. For example, if a diameter of the second yarns is smaller a diameter of the first yarns, the second yarn layer 32 may be more flexible than the first yarn layer. Preferably, the belt is configured to stretch elastically more in the second direction of the belt than in the first direction of the belt. Further, the belt is preferably configured to stretch elastically more in the travel direction of the belt than in the cross direction of the belt.

The strength of yarns, i.e., specific stress (N/tex), of each second yarn 32*a* can be e.g. in a range between 0.5 N/tex and 2 N/tex. N/tex refers to Newton per tex. Thus, it is possible to obtain good strength properties in travel direction of the belt.

The strength of yarns, i.e., specific stress (N/tex), of each first yarn 31*a* can be e.g. in a range between 0.4 N/tex and 3 N/tex. Thus, it is possible to obtain good cross directional strength for the belt.

A tensile strength of the first yarns may be higher, preferably at least 4% higher, more preferably at least 8% higher, referred to a unit area of the sleeve roll belt, than the tensile strength of the second yarns.

The breaking strength of the sleeve roll belt can be e.g. equal to or more than 100 kN/m, preferably equal to or more than 140 kN/m, and most preferably equal to or more than 160 kN/m, such as from 170 kN/m to 230 kN/m, measured in the travel direction of the sleeve roll belt. Thus, the belt may not be easily damaged even in special cases e.g. due to an emergency stop of a machine, or if there is not much oil between the outer surface of the sleeve roll and the inner surface of the sleeve roll belt e.g. due to starting of the sleeve roll after a machine downtime. Further, said breaking strength of the belt may be smaller than a breaking strength of the sleeve roll in order to protect the sleeve roll. Still further, said breaking strength of the belt may provide good elasticity for the sleeve roll belt.

Elasticity of the sleeve roll belt is the ability of the belt to return to its original shape when a force is removed. The sleeve roll belt can be elastic so that it will return to its initial shape and length when the forces caused by a sleeve roll are removed. The stretching of the belt can be controlled by the reinforcing structure 30 of the sleeve roll belt.

The sleeve roll belt can have a lighter reinforcing structure in the second direction D2 than in the first direction D1 of the belt, hence, the novel sleeve roll belt can have a high stretchability in the second direction. Therefore, the yarns of the second yarn layer can yield and thus stretch in their longitudinal direction when the sleeve roll belt is bent, for example, on the curve element 110 such that it needs to stretch. However, the reinforcing structure can still be able to control the stretching level of the belt. Thus, the novel sleeve roll belt may not be as easily damaged as a belt could be without the reinforcing structure.

A load at specific elongation (LASE) as well as breaking strength can be determined based on the standard SFS 2983. The values can be determined by using Alwetron TCT 20 device from Lorentzen & Wettre AB (Lorentzen & Wettre, Sweden). A constant rate of elongation (CRE) is used while determining test values. The application of load is made in such a way that the rate of elongation of the sample is kept constant. A computerized control system can be used to maintain constant force. The elongation rate applied to the samples is 10 mm/min. During the measurements, a sample between the stationary and the moving clamp is extended by a constant distance per unit of time (10 mm/min) and the force required to do so is measured. The breaking elongation is calculated from the clamp displacement.

The total size of the sample is 240 mm×30-40 mm, wherein the length of the test sample is 240 mm, and the width of the sample is 40 mm in the both ends of the sample and 30 mm in the middle of the sample. The width of the sample in contact with the clamp is 40 mm. During measurements, a load of 2 kN±0.1% is used for samples having a maximum load of less than 1.7 kN. Further, a load of 20 kN±0.1% is used for samples having a maximum load equal to or more than 1.7 kN.

The sleeve roll belt can be configured to have a LASE 2% in a range between 28 kN/m and 50 kN/m. The LASE 2% can be equal to or more than 28 kN/m, typically equal to or more than 30 kN/m, and most preferably equal to or more than 35 kN/m, determined in the travel direction of the sleeve roll belt and measured according to standard SFS 2983. Further, the LASE 2% may be equal to or less than 50 kN/m, or equal to or less than 40 kN/m, determined in the travel direction of the sleeve roll belt and measured according to standard SFS 2983. Thus, the belt may have a good stretchability level.

The sleeve roll belt can be configured to have a LASE 4% in a range between 47 kN/m and 60 kN/m. The LASE 4% can be equal to or more than 47 kN/m, typically equal to or more than 50 kN/m, and most preferably equal to or more than 52 kN/m, determined in the travel direction of the sleeve roll belt and measured according to standard SFS 2983. Further, the LASE 4% may be less than 60 kN/m, for example equal to or less than 58 kN/m, determined in the travel direction of the sleeve roll belt and measured according to standard SFS 2983. The technical effect is that the belt may perform well with high loads and have good stretchability as well as good dimensional stability properties. Further, belts having said specific elongations (LASE 2% and LASE 4%) may have good predictability, i.e., elongations of the belt may be predicted in different stresses.

The sleeve roll belt can be configured to stretch equal to or more than 1.5%, such as in a range between 1.5% and at least 3.0%, or from 2.0% to 4.0%, in the travel direction of the belt so that it will return to its original length after the force stretching the belt has been removed. Preferably, the sleeve roll belt can be configured to stretch at least 2.0%, more preferably at least 2.2% in the travel direction of the sleeve roll belt so that it will return to its original length after the force stretching the belt has been removed.

The sleeve roll belt, as well as the yarn layers therein, can be made in manners known per se. The sleeve roll belt can be manufactured, e.g., by providing several support yarns;

shaping an elastic body for a sleeve roll belt by casting at least one elastomer material against a mold surface;

curing the frame; and optionally, providing the outer surface of the frame with several grooves.

The sleeve roll belt is intended to be installed on the sleeve roll of a board machine, a paper machine, a pulp machine or a tissue machine, preferably in the wire section therein. The sleeve roll belt may further comprise e.g. plurality of attaching points 60 of the belt for an installation of the belt.

Thanks to the novel solution, a radius of curvature on the curve element 110 can be smaller than conventionally. Hence, it may be possible to use such curve elements which can cause a very small radius of curvature to the belt. This may improve the effectiveness of the sleeve roll 100.

EXAMPLE

Samples of a novel sleeve roll belt were tested according to the standard SFS 2983.

According to the test results, the LASE 2% was 29 kN/m. Further, the LASE 4% was 52 kN/m. Thus, the loads needed for said specific elongations (LASE 2% and LASE 4%) were at a suitable level for sleeve roll belts.

Further, when the samples were stretched by using a force of 30 kN/m, the samples were able to return to their original length after the force was removed. Thus, the elasticity of the samples was at a good level for sleeve roll belts.

Furthermore, the breaking points of the samples were tested. The average elongation, in which the samples were broken, was 22.40%, with a minimum value of 21.90% and a maximum value of 23.22%. The average load, in which the samples were broken, was 199 kN/m, with a minimum value of 194 kN/m and a maximum value of 206 kN/m.

Thus, according to the test results, the novel belt had properties suitable for sleeve rolls having a curve element.

The invention has been described with the aid of illustrations and examples. The invention is not limited solely to the above presented embodiments but may be modified within the scope of the appended claims.

I claim:

1. A sleeve roll belt in a forming section of a paper, board, pulp or tissue machine, the belt forming a closed loop and the closed loop being arranged to rotate and travel in a machine direction, the belt comprising:

an elastic body forming the closed loop and defining an inner surface within the closed loop, and an outer surface outside the closed loop, wherein the elastic body is between the inner surface and the outer surface;

a reinforcing structure arranged within the elastic body and comprised of first yams extending in a first direction which is at least substantially in a cross machine direction, wherein the cross machine direction is transverse to a machine direction in which the belt is arranged to rotate, and second yams extending in a second direction which is at least substantially in the machine direction;

wherein the belt is configured to stretch elastically more in the second direction than in the first direction so that it will return to its original length after forces stretching the belt have been removed;

wherein a number of the second yams per meter in the first direction is greater than a number of the first yams per meter in the second direction and wherein the number of the second yarns per meter is at least 1.25 times the number of the first yarns per meter.

2. The sleeve roll belt of claim 1 wherein the number of the second yams is in a range between 490 yarns/m and 630 yarns/m.

3. The sleeve roll belt of claim 2 wherein the number of the first yams is in a range between 230 yarns/m and 390 yarns/m.

4. The sleeve roll belt of claim 1 wherein the number of the first yams is in a range between 230 yarns/m and 390 yarns/m.

5. The sleeve roll belt of claim 1 wherein a diameter of the second yarns is smaller than a diameter of the first yarns.

6. The sleeve roll belt of claim 5 wherein a diameter of the first yarns is in a range between 0.5 mm and 2.0 mm.

7. The sleeve roll belt of claim 6 wherein a diameter of the second yarns is in a range between 0.5 mm and 1.5 mm.

8. The sleeve roll belt of claim 1 wherein a diameter of the second yarns is in a range between 0.5 mm and 1.5 mm.

9. The sleeve roll belt of claim 1 wherein the first yarns form an innermost yarn layer, which is closer to the inner surface of the belt than the second yarns.

10. The sleeve roll belt of claim 9 wherein the second yarns form an outermost yarn layer which is closer to the outer surface of the belt than the first yarns.

11. The sleeve roll belt of claim 1 wherein the second yarns form an outermost yarn layer, which is close to the outer surface of the belt than the first yarns.

12. The sleeve roll belt belt of claim 1 wherein the belt is configured to stretch elastically at least 1.5% in the second direction.

13. The sleeve roll belt of claim 12 wherein the belt is configured to stretch elastically in a range between 1.8% and 3.0% in the second direction so that the belt will return to its original length after forces stretching the belt are removed.

14. The sleeve roll belt of claim 1 wherein a load at specific elongation of 2% in the second direction of the belt is equal to or greater than 28 kN/m and equal to or less than 50 kN/m.

15. The sleeve roll belt of claim 1 wherein a load at specific elongation of 4% in the second direction of the belt is equal to or more than 49 kN/m and equal to or less than 70 kN/m.

16. The sleeve roll belt of claim 1 wherein the belt is configured to stretch elastically at least 4% more in the second direction of the belt than in the first direction of the belt.

17. The sleeve roll belt of claim 1 wherein the belt is configured to stretch elastically at least 8% more in the second direction of the belt than in the first direction of the belt.

18. The sleeve roll belt of claim 1 wherein the belt is configured to return to its original length after a load of 25 kN/m to 30 kN/m stretches the belt in the travel direction of the belt and the load is removed.

19. The sleeve roll belt of claim 1 wherein the belt has a tensile elongation at break of 20% to 25%, measured at a temperature of 20° C. in the travel direction of the belt.

20. The sleeve roll belt of claim 1 wherein the belt has a breaking strength in a range between 130 kN/m and 230 kN/m in the machine direction.

21. The sleeve roll belt of claim 1 wherein the first yarns are composed of a fiber selected from the group consisting of: polyamide, polyethylene, aromatic polyamide, polyester, polyethylene terephthalate, carbon fibers, and a carbon fiber thermoplastic composite; and wherein the second yarns are composed of a fiber selected from the group consisting of: polyester, polyethylene terephthalate, polyamide, polyethylene, aromatic polyamide, carbon fibers, and a carbon fiber thermoplastic composite.

22. The sleeve roll belt of claim 1 wherein the elastic body of the belt has portions comprising a plurality of dewatering grooves in the outer surface and arranged in the machine direction of the sleeve roll belt, the dewatering grooves being separated by lands, each of the dewatering grooves having a depth below the outer surface of from 0.3 to 1.5 mm.

23. The sleeve roll belt of claim 1 wherein the second yams extending in a second direction which is at least substantially in the machine direction comprise adjacent second yams, and groove-forming portions of each of the adjacent second yams extend above the outer surface of the sleeve roll belt, said groove-forming portions of said adjacent second yarns defining parallel grooves therebetween.

24. An arrangement comprising a sleeve roll; and a belt having an elastic body forming a closed loop about the sleeve roll and defining an inner surface within the closed loop, and an outer surface outside the closed loop, wherein the elastic body is between the inner surface and the outer surface;

a reinforcing structure arranged within the elastic body and comprised of first yarns extending in a first direction which is at least substantially in a cross machine direction, wherein the cross machine direction is transverse to a machine direction in which the belt is arranged to rotate, and second yarns extending in a second direction which is at least substantially in the machine direction;

wherein the belt is configured to stretch elastically more in the second direction than in the first direction so that it will return to its original length after forces stretching the belt have been removed;

wherein a number of the second yarns per meter in the first direction is in a range between 490 yarns/m and 630 yarns/m and a number of the first yarns per meter in the second direction is in a range between 230 yarns/m and 390 yarns/m wherein the number of the second yarns per meter is at least 1.25 times the number of the first yarns per meter.

25. A method of using a belt on a sleeve roll in a fiber web machine, comprising:

dewatering a fiber web in a fiber web machine with a sleeve roll supporting a belt having an elastic body forming a closed loop about the sleeve roll and defining an inner surface within the closed loop, and an outer surface outside the closed loop, wherein the elastic body is between the inner surface and the outer surface;

wherein a reinforcing structure is arranged within the elastic body, the reinforcing structure being comprised of first yarns extending in a first direction which is at least substantially in a cross machine direction, wherein the cross machine direction is transverse to a machine direction in which the belt is arranged to rotate, and second yarns extending in a second direction which is at least substantially in the machine direction;

wherein the belt is configured to stretch elastically more in the second direction than in the first direction so that it will return to its original length after forces stretching the belt have been removed;

wherein a number of the second yarns per meter in the first direction is in a range between 490 yarns/m and 630 yarns/m and a number of the first yarns per meter in the second direction is in a range between 230 yarns/m and 390 yarns/m, and wherein the number of the second yarns per meter is at least 1.25 times the number of the first yarns per meter.

* * * * *